US010016645B1

(12) United States Patent
Reynolds et al.

(10) Patent No.: US 10,016,645 B1
(45) Date of Patent: Jul. 10, 2018

(54) ROPE CLIMBING APPARATUS

(71) Applicants: Lynn Reynolds, Wasilla, AK (US); Joseph F. Maestas, Wasilla, AK (US)

(72) Inventors: Lynn Reynolds, Wasilla, AK (US); Joseph F. Maestas, Wasilla, AK (US)

( * ) Notice: Subject to any disclaimer, the term of this patent is extended or adjusted under 35 U.S.C. 154(b) by 82 days.

(21) Appl. No.: 15/054,618

(22) Filed: Feb. 26, 2016

(51) Int. Cl.

| | |
|---|---|
| ***A63B 7/04*** | (2006.01) |
| ***A63B 21/008*** | (2006.01) |
| ***A63B 21/00*** | (2006.01) |
| ***A63B 23/12*** | (2006.01) |

(52) U.S. Cl.
CPC ..... *A63B 7/045* (2013.01); *A63B 21/008* (2013.01); *A63B 21/4027* (2015.10); *A63B 23/12* (2013.01)

(58) Field of Classification Search
CPC ... A63B 7/045; A63B 21/4027; A63B 21/008; A63B 23/12
USPC ..... 482/37
See application file for complete search history.

(56) References Cited

U.S. PATENT DOCUMENTS

| | | | | | |
|---|---|---|---|---|---|
| 3,599,974 | A * | 8/1971 | Price | A63B 21/015 | 242/156 |
| 5,076,574 | A * | 12/1991 | Johnson, Jr. | A63B 7/04 | 482/112 |
| D343,876 | S * | 2/1994 | McConnell | D21/676 | |
| 5,484,360 | A * | 1/1996 | Haber | A63B 7/04 | 482/37 |
| 6,261,208 | B1 * | 7/2001 | Carson, Jr. | A63B 7/04 | 482/114 |
| 6,808,474 | B2 * | 10/2004 | Tang | A63B 21/018 | 482/120 |
| 7,018,323 | B1 * | 3/2006 | Reynolds | A63B 7/04 | 482/112 |
| 7,060,003 | B1 * | 6/2006 | Reynolds | A63B 7/04 | 273/451 |
| 7,303,506 | B1 * | 12/2007 | Reynolds | A63B 7/04 | 482/112 |
| 2004/0014568 | A1 * | 1/2004 | Williams | A63B 7/04 | 482/37 |
| 2005/0148437 | A1 * | 7/2005 | Ryan | A63B 21/018 | 482/37 |
| 2007/0275829 | A1 * | 11/2007 | Popescu | A63B 7/045 | 482/37 |
| 2009/0137370 | A1 * | 5/2009 | Kushnir | A63B 21/00069 | 482/120 |
| 2010/0041520 | A1 * | 2/2010 | Popescu | A63B 23/1209 | 482/37 |
| 2011/0224057 | A1 * | 9/2011 | Wu | A63B 21/0552 | 482/130 |
| 2012/0040809 | A1 * | 2/2012 | Formicola | A61H 1/0237 | 482/131 |
| 2012/0142503 | A1 * | 6/2012 | Sevadjian | A63B 21/0442 | 482/99 |

(Continued)

*Primary Examiner* — Andrew S Lo
(74) *Attorney, Agent, or Firm* — Michael J. Tavella

(57) ABSTRACT

A rope-climbing machine that has a simplified frame that reduces the cost of manufacture without sacrificing safety and overall strength. The machine is made of three parts-a mast, a base structure and a braking system. The mast is a length of pipe. The endless rope passes through this pipe as part of the operation of the device. There is a guide pulley attached to the top of the mast that directs the rope downwards. The braking system for the rope is attached to the base of the mast. The mast is attached to the back portion of the base, which holds the mast and provides a stable base for the device.

8 Claims, 9 Drawing Sheets

(56) References Cited

U.S. PATENT DOCUMENTS

| | | | | |
|---|---|---|---|---|
| 2013/0035220 | A1* | 2/2013 | Adams | A63B 21/04 482/129 |
| 2014/0221179 | A1* | 8/2014 | Chen | A63B 21/0051 482/130 |

* cited by examiner

ROPE CLIMBING APPARATUS

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to rope climbing apparatuses and particularly to a rope climbing apparatus using endless ropes.

2. Description of the Prior Art

Climbing ropes have been a part of fitness gyms for many years. Climbing ropes provide excellent exercise for the wrists, hands and upper body. Traditionally, climbing ropes have been long (20 foot) lengths of rope that were suspended from a gym ceiling. There are two problems with the traditional fixed rope as an exercise tool. First, there are few buildings used for gyms today that have high enough ceilings. Second, a 20-foot length of rope does not provide enough sustained effort to enable someone skilled in rope climbing exercise to receive a sufficient workout. Once a person has reached the top of the rope, he or she must descend before he or she can climb again. Moreover, climbing 20 feet or more can increase the risk of injury due to falling.

To overcome these difficulties, endless rope exercise machines have been invented. These devices use a frame, an endless length of rope and a means of resistance to simulate actual rope climbing. Such machines enable a user to "climb" a rope for as long as the user's stamina permits. U.S. Pat. No. 5,076,574 discloses a portable rope climbing exercise apparatus that has a frame, a series of pulleys supporting a rope, and a hydraulic brake system to provide resistance for the rope.

In addition to vertical rope climbing machines, horizontal rope pulling machines, that can simulate a tug-of-war, have also been developed. One example of such a machine is found in U.S. Pat. No. 5,318,491, which shows a machine that has a rope extending from a control box. The box has parts that adjust the tension of the rope and the pulling force. The user stands on a treadmill. As the user pulls on the rope, the user moves on the treadmill. Alternatively, the treadmill can be locked for static rope pulling. The problem with this machine is that it is bulky with the treadmill. Moreover, although this device can simulate a tug-of-war, such a simulation is not the best exercise that can be obtained using a climbing rope. The displacement of the rope is such that it is not guarded. Thus, it appears that when not in use, the rope is left lying on the treadmill, which is a tripping hazard. In addition, the rope is dispensed through two holes that are narrowly spaced apart. This can lead to discomfort when the rope is under tension, because the loop may close on the user's hands.

Finally, our previous patents, U.S. Pat. Nos. 7,303,506, 7,060,003, and 7,018,323 teach various types of rope climbing machines.

The problem with all of these machines is that they are costly to produce. Simplifying the construction can reduce the cost of manufacturing, but this must be done with safety in mind and with the idea of retaining the beneficial capabilities of such machines.

BRIEF DESCRIPTION OF THE INVENTION

The instant invention overcomes these difficulties. It is a rope-climbing machine that has a simplified frame that reduces the cost of manufacture without sacrificing safety and overall strength. To achieve this, the machine is made of two parts-a mast, and a base frame. The mast is a length of pipe. The endless rope passes through this pipe as part of the operation of the device. There is a guide pulley attached to the top of the mast that directs the rope downwards. A braking system for the rope (that provides resistance, which allows the user to gain strength) is placed at the bottom of the mast. The base frame holds the mast and provides a stable base for the device.

The main difficulty of using this machine is that the rope must be spliced once it is installed to make it a continuous rope. In the machines discussed above, the frame allowed a pre-spliced endless rope to be draped over the various pulleys and to be inserted into the frame.

In this invention, a method of splicing the rope is used to connect the ends of the rope together such that the strength of the rope is not reduced below the minimum strength required for safe operation and, more importantly, that the diameter of the splice is not greater than the overall diameter of the rope. Thus, this invention includes a splice method, which is needed to make this invention work. The splicing method is taught in our copending application entitled "Method Of Splicing A Rope", which is incorporated herein by reference.

DETAILED DESCRIPTION OF THE INVENTION

Figure 1:
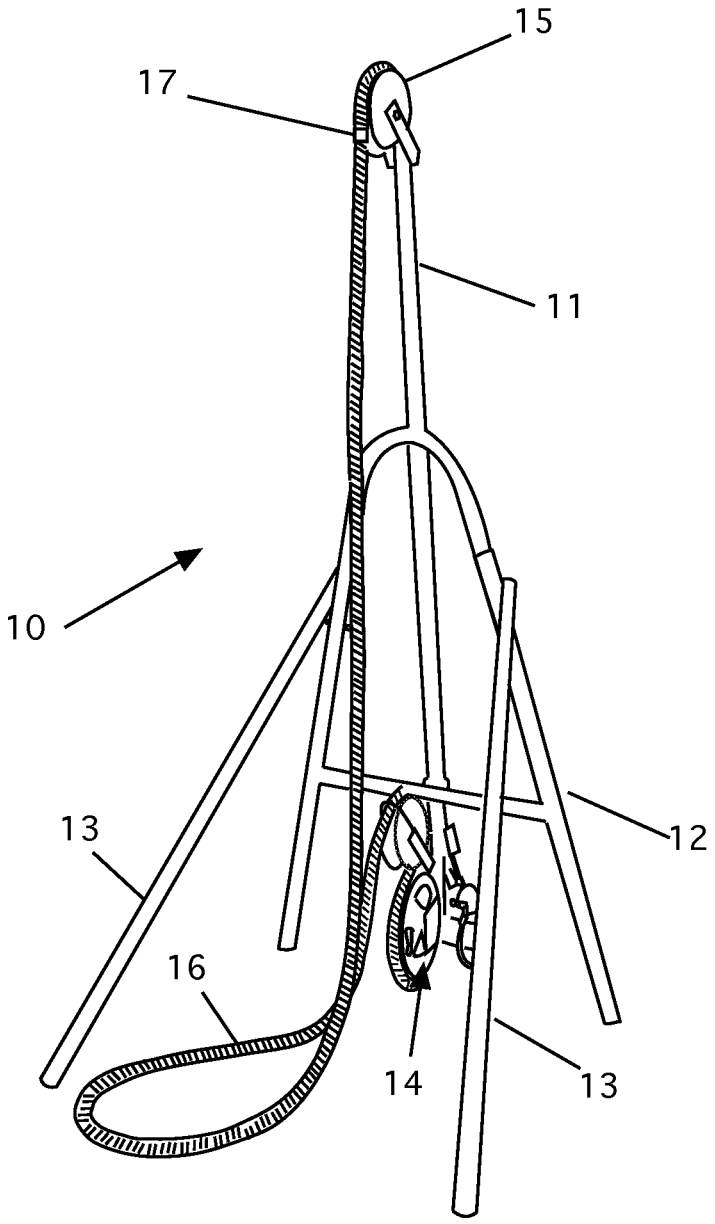
FIG. 1 is a front perspective view of the invention fully assembled.

Referring now to FIG. 1, a front perspective view of the invention 10. The invention consists of a mast 11, a base frame 12 a pair of front leg members 13, a braking system 14, a top pulley 15 and an endless rope 16. As noted above, the endless rope is made by splicing the ends with a splice 17, which is described in our copending application "Method Of Splicing A Rope", which is incorporated herein by reference. The most important aspect of the splice 17 is that it is the same diameter as the rope 16 so that it can freely pass through the mast and the braking system 14 without impairing the movement of the rope. Note that in this figure, the breaking system 14 is shown in the front view.

Figure 2:
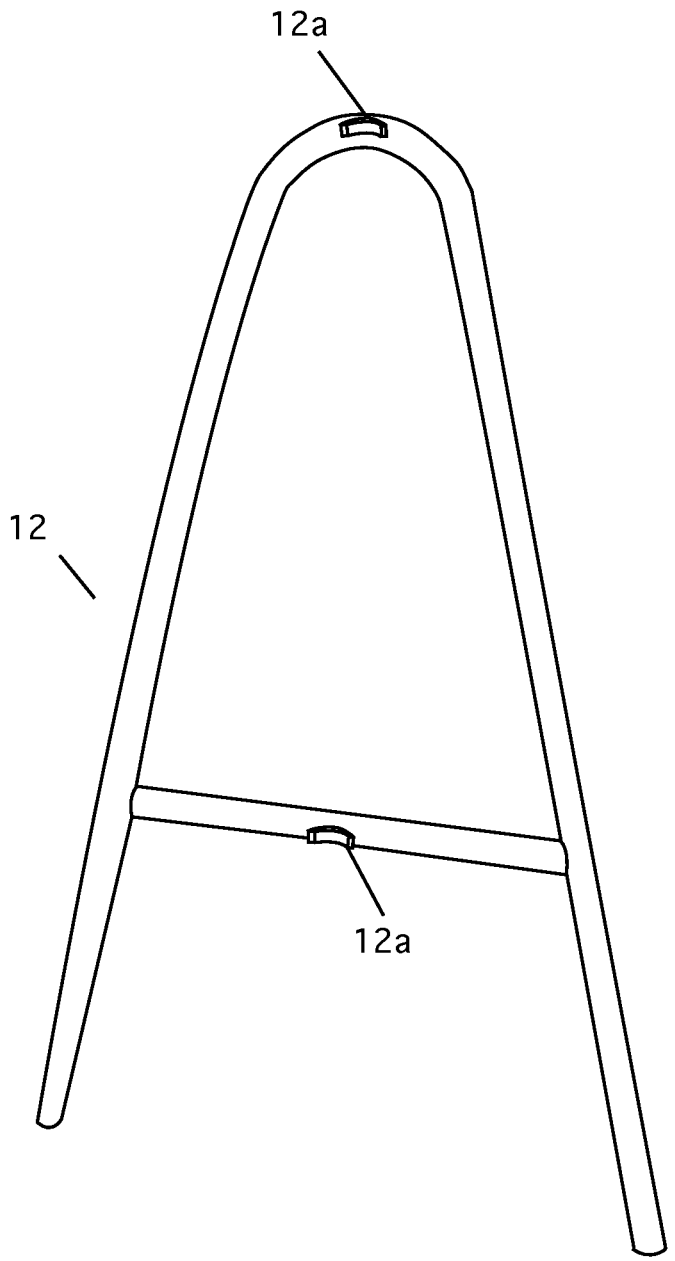
FIG. 2 is a rear perspective view of the base frame.

FIG. 2 is a rear perspective view base frame 12. Note that in this rear view, two brackets 12*a* are shown. These brackets are curved to accept the mast 11, which is placed against them and secured in place with appropriate fasteners (not shown).

Figure 3A:
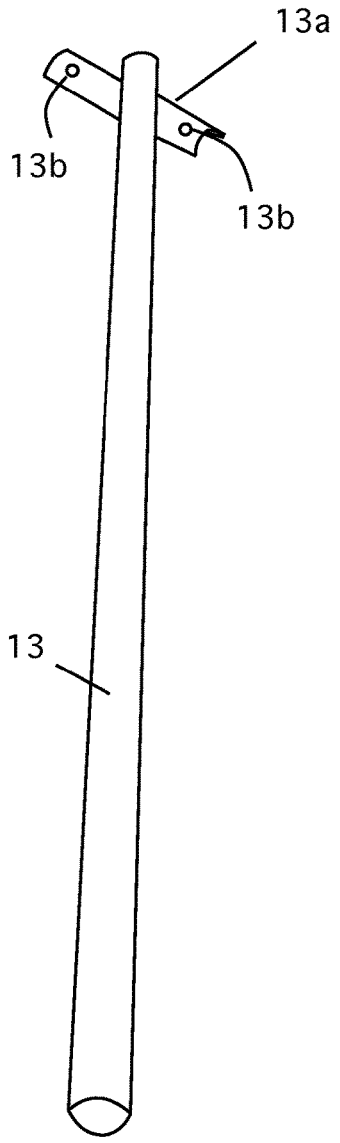
FIG. 3*a* is a rear perspective view of one of the base frame legs.
Figure 3B:
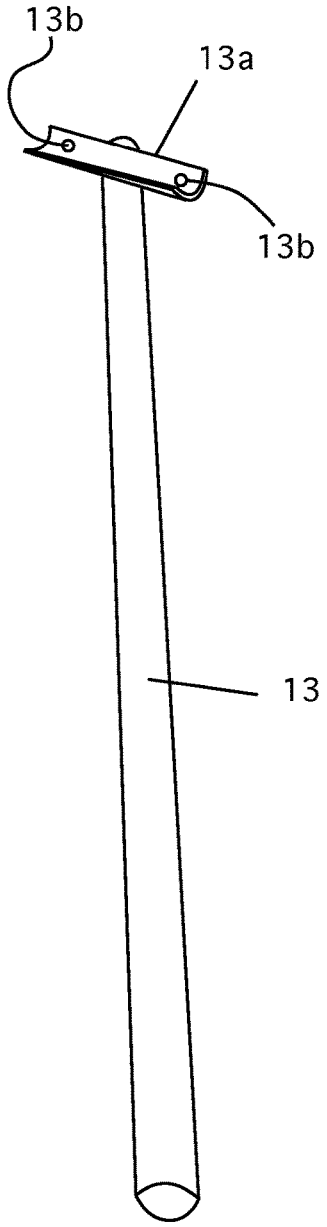
FIG. 3*b* is a front perspective view of one of the base frame legs.
Figure 3C:
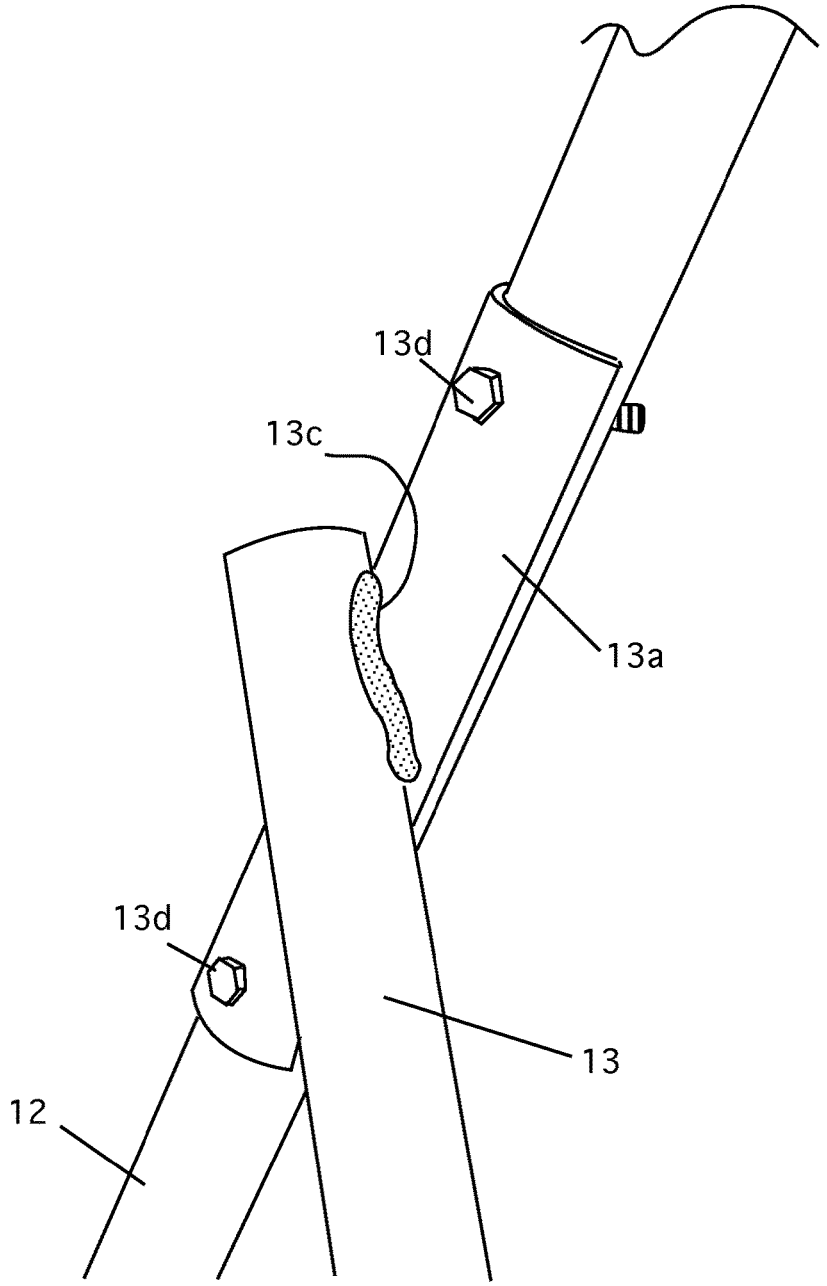
FIG. 3*c* is a detail of the leg joined to the base frame.

FIG. 3*a* is a rear perspective view of one of the base frame leg members 13. FIG. 3*b* is a front perspective view of one of the base frame leg members 13. Each of the two leg members 13 has a curved bracket 13*a* attached to it, as shown. The brackets 13*a* have holes 13*b* that are used to hold the leg members 13 to the rear frame 12. The brackets 13*a* are welded to the leg members 13 with welds (13*c* on FIG. 3*c*, in one example). As shown in FIG. 3*c*, the brackets 13*a* are then joined to the rear frame 12 with fasteners 13*d*. Once the leg members 13 are properly set, the fasteners 13*d* are tightened and the brackets are locked onto the base frame 12.

Figure 4:
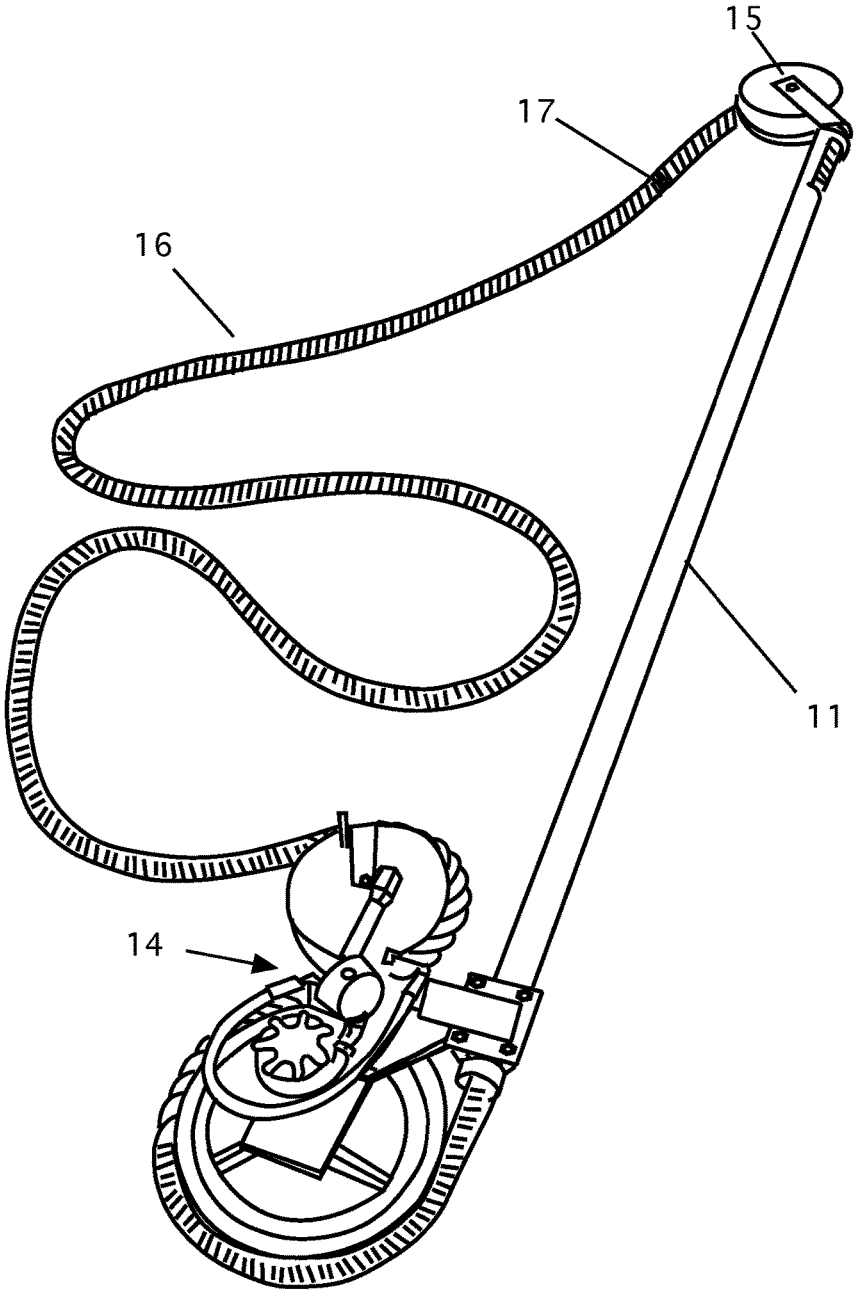
FIG. 4 is a detail view of the mast and braking system.

FIG. 4 is a detail perspective view of the mast 11 attached to the braking system 14. This figure also shows the rope 16 and splice 17 as well as the top pulley 15. This figure also shows the path of the rope 16, which is independent of the leg members 13 and base frame 12.

Figure 5:
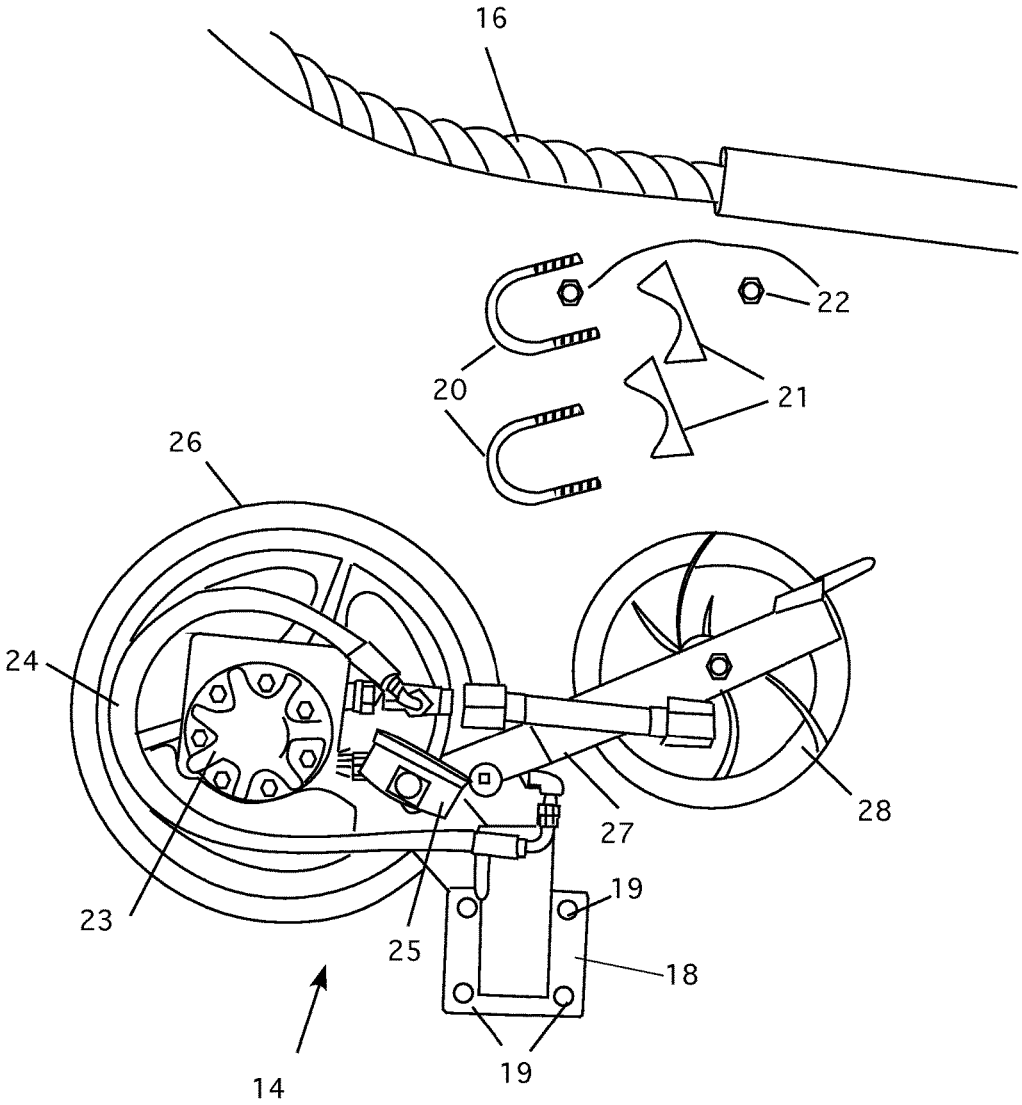
FIG. 5 is a detail view of the braking system and the parts used to attach it to the mast.

As shown in FIG. 4, the mast 11 is bolted to the braking system 14. FIG. 5 shows the parts that make up the braking assembly 14 as well as the parts used to attach the mast. The braking system 14 has a bracket 18 that has mounting holes 19. A pair of U-bolts 20, a pair of curved brackets 21 and nuts 22 make up the rest of the components that attach the mast to the braking system. This is done by placing the braking system 14 onto the mast 11 (see FIG. 6) and then placing the curved brackets 21 on the backside of the mast such that the curved portion is abutting the mast. The brackets are aligned with the holes 19 on the bracket 18. The U-bolts 20 are placed through the curved brackets so that the threaded ends of the U-bolts pass through the bracket 18. The nuts 22 secure the U-bolts and the mast to the bracket 18.

Assuming the user is looking at the machine from the front (i.e., standing in front of the rope), FIG. 5 shows details of the braking system 14 from the right side. This system uses a hydraulic motor 23 with hose 24 and control valve 25 that is attached to a large drive pulley 26. A swing arm 27 is hingeably secured by a nut 27*a*, which allows the swing arm to pivot, and tension the rope against the drive pulley 26. A secondary guide pulley 28 is attached to the swing arm 27. The rope 16 is passed over and between these pulleys (see FIG. 4). The hydraulics control the ease of turning of the large drive pulley 26, which provides a resistance to the user when climbing the rope in a simulated rope climb. In actual practice, the rope descends and goes over the secondary pulley then onto the drive pulley before entering the bottom of the mast.

Figure 6:
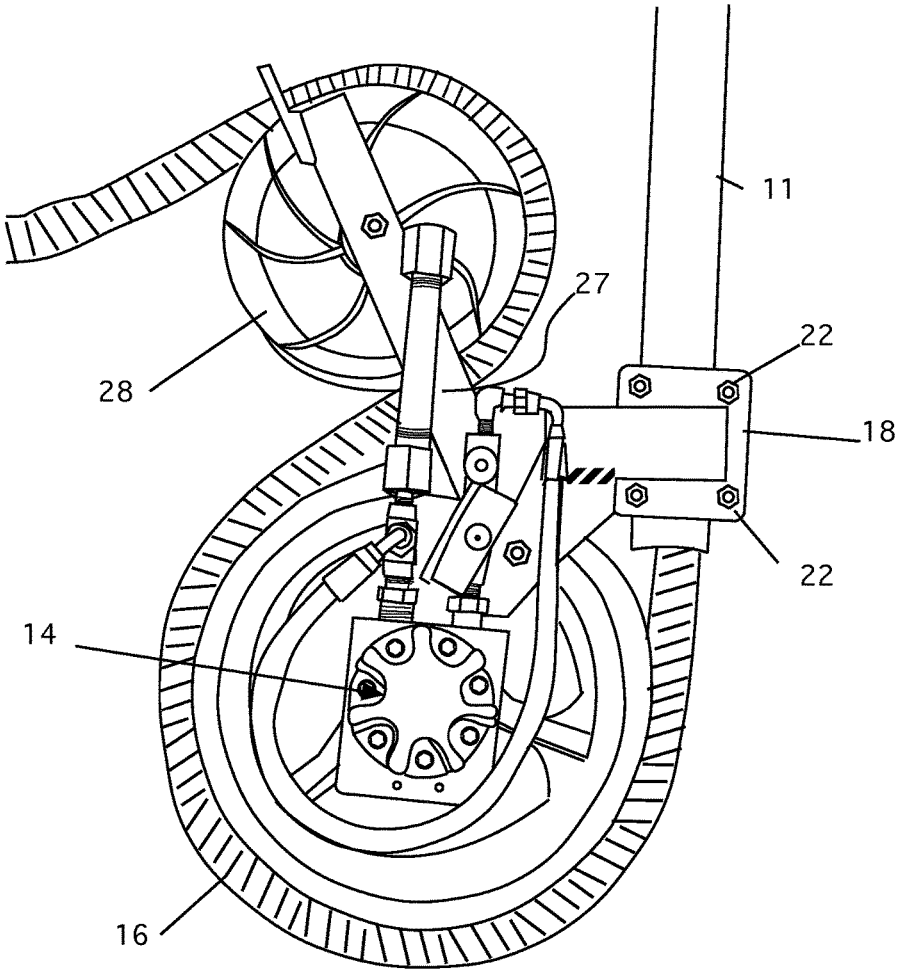
FIG. 6 is a detail view of the right side of the braking system attached to the mast.

FIG. 6 is another detail view of the right side of the braking system attached to the mast. Here, a slightly larger view of the braking system 14 is shown. The swing arm 27 and nut 27*a* the secondary pulley 28 as well as the rope 16 and the mast 11 are shown. Note too, the bolts 22 are shown securing the mast to the bracket 18. Note that this bracket is an integral part of the frame 18*a* that holds the motor, the drive pulley and the swing arm 27.

Figure 7:
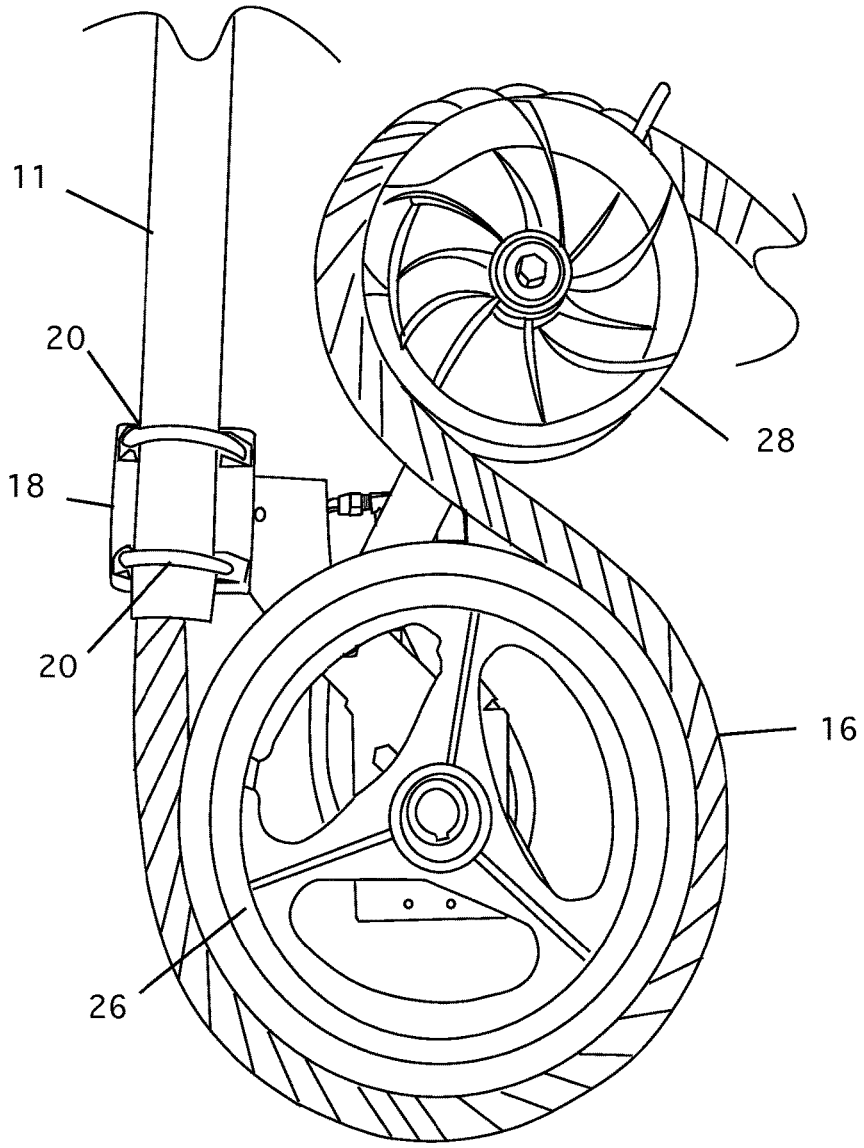
FIG. 7 is a detail view of the left side of the braking system attached to the mast.

FIG. 7 is a detail view of the left side of the braking system attached to the mast. Here, the U-bolts 20 are shown attaching the mast 11 to the bracket 18, as part of the overall bracket 18*a*. Note both the drive pulley 26 and the secondary pulley 28 are shown. Note too, the exact routing of the rope 16 is shown. Of course, the braking system 14 is only one example of systems that can be used to add resistance to the rope. Although preferred, any of a number of similar systems could be used as well.

Figure 8:
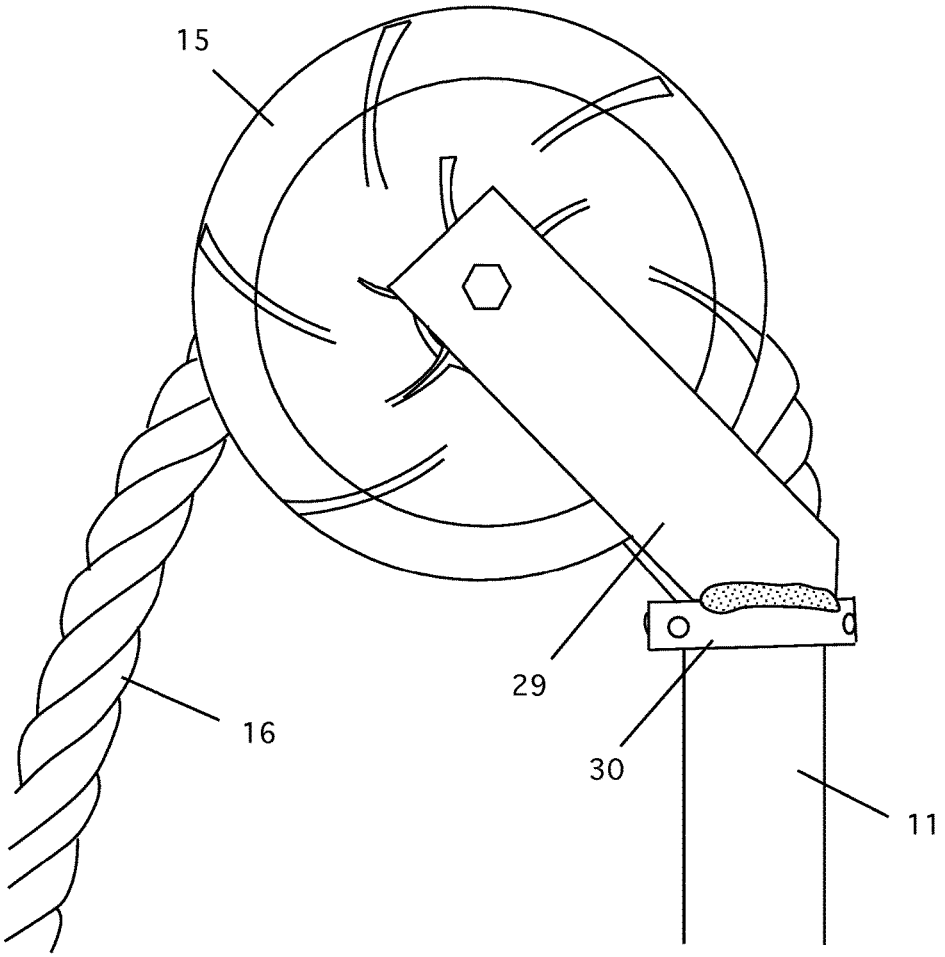
FIG. 8 is a side detail view of the pulley at the top of the mast.

FIG. 8 is a side detail view of the top pulley 15 at the top of the mast 11. Note that the top pulley 15 is secured to the mast with a bracket 29, which is welded to a collar 30 that is attached to the mast 11. The top pulley brings the rope up from the mast, over the pulley and back down the front of the device.

In practice, and in the preferred embodiment, the device is partially assembled at the factory, including running the rope through the mast and splicing it at the factory. Although the rope can be spliced in the field, field splices are only used in the rare instance that the rope breaks in the field.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

We claim:

1. A rope climbing apparatus comprising:

a) a back frame; and b) a pair of leg members, attached to said back frame and extending outwardly therefrom;

c) a mast, attached to said back frame and extending upwardly therefrom, said mast being a cylindrical tube having a diameter, said mast further having an open top, a bottom portion, and an open bottom;

d) a guide pulley attached to the top of said mast; and e) an endless rope having a diameter slightly smaller than the diameter of said mast, being threaded through said mast; and f) a braking system, attached to said mast, said braking system being in operative communication with said endless rope.

2. The rope climbing apparatus of claim 1 wherein each of said pair of leg members includes a curved bracket attached to said leg member.

3. The rope climbing apparatus of claim 1 wherein the guide pulley directs the endless rope downwardly from said mast.

4. The rope climbing apparatus of claim 1 wherein the braking system is attached to the bottom portion of said mast.

5. The rope climbing apparatus of claim 4 wherein said endless rope enters said mast at said open bottom after engaging said braking system.

6. The rope climbing apparatus of claim 1 wherein said braking system includes:

a) a frame;

b) a secondary pulley, attached to said frame and being in operative communication with said endless rope;

c) a drive pulley, having a rotating capability, attached to said frame and being in operative communication with said endless rope and having a rotating capability; and d) a brake, attached to said frame and being in operative communication with said drive pulley.

7. The rope climbing apparatus of claim 6 wherein said brake includes a hydraulic motor.

8. The rope climbing apparatus of claim 7 wherein said hydraulic motor provides resistance to the rotating capability of said drive pulley, thereby increasing the force required to move said endless rope over said drive pulley.

* * * * *